United States Patent [19]

Meinke et al.

[11] 4,070,677

[45] Jan. 24, 1978

[54] WINDOW ANTENNA AND DEFROSTER WITH MEANS FOR REDUCING RADIO INTERFERENCE

[75] Inventors: Hans Heinrich Meinke, Gauting; Heinz Lindenmeier, Planegg; Friedrich Landstorfer, Munich; Gerhard Flachenecker, Ottobrunn, all of Germany

[73] Assignee: Hans Kolbe & Co., Bad Salzdetfurth, Germany

[21] Appl. No.: 743,467

[22] Filed: Nov. 18, 1976

[30] Foreign Application Priority Data

Nov. 20, 1975 Germany ..... 2552002

[51] Int. Cl.[2] ..... H01Q 1/32

[52] U.S. Cl. ..... 343/704; 343/713

[58] Field of Search ..... 343/713, 712, 711, 885, 343/703, 704; 219/203, 522

[56] References Cited

U.S. PATENT DOCUMENTS

| | | | |
|---|---|---|---|
| 3,484,584 | 12/1969 | Shaw, Jr. | 343/713 |
| 3,964,068 | 6/1976 | Torii et al. | 343/713 |
| 3,971,029 | 7/1976 | Torii et al. | 343/713 |

*Primary Examiner*—Alfred E. Smith
*Assistant Examiner*—David K. Moore
*Attorney, Agent, or Firm*—Michael J. Striker

[57] ABSTRACT

A vehicle window heater includes an arrangement of heating conductors provided on the window. A radio receiving antenna is located in the vicinity of the heating conductors. An interference-suppressing arrangement decreases the effect upon the antenna of interference fields emanating from the heating conductors and includes an arrangement of auxiliary conductors located in the vicinity of the heating conductors. The auxiliary conductors along their lengths are insulated from the heating conductors. Each auxiliary conductor at at least one of its ends is conductively connected to the vehicle body for high-frequency condition.

22 Claims, 15 Drawing Figures

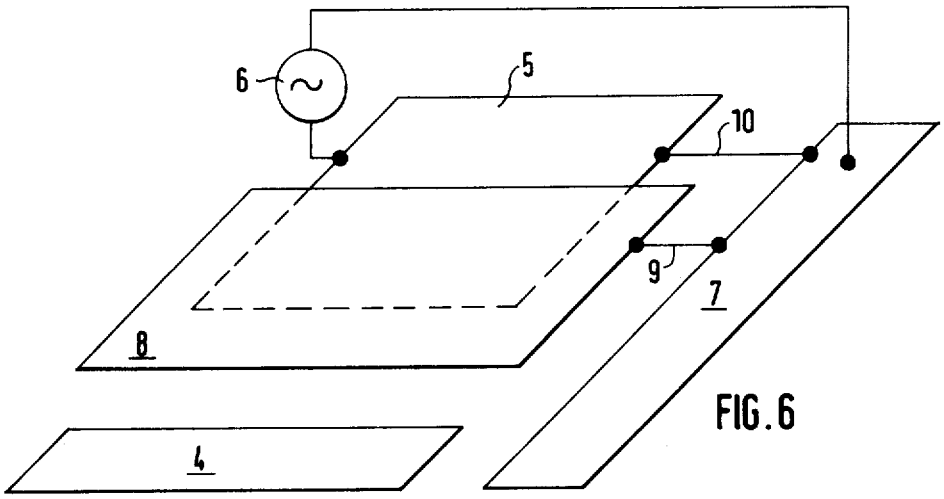
FIG. 6
FIG. 7
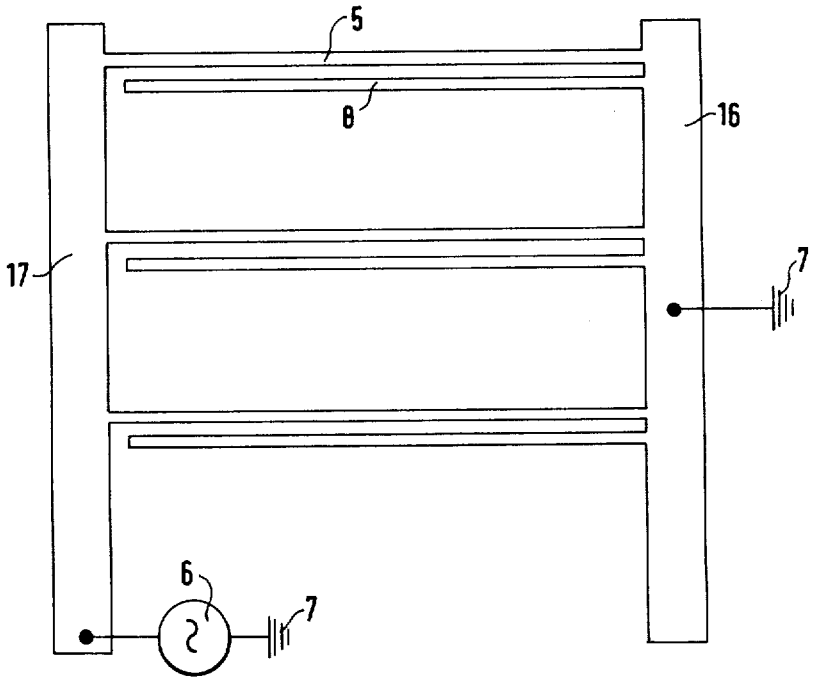

WINDOW ANTENNA AND DEFROSTER WITH MEANS FOR REDUCING RADIO INTERFERENCE

BACKGROUND OF THE INVENTION:

The invention relates to an arrangement for reducing the effect of radio interference upon a receiving antenna provided upon the windshield of an automotive vehicle when the windshield is also provided with heating conductors arranged in the vincinity of the antenna.

It is known that such heating conductors produce high-frequency interference fields in their general vicinity, due to the fact that they conduct not only heating current but also interference currents. These interference currents are generated, for example, as a result of the operation of the ignition system of the engine of the vehicle, and are transmitted via the current supply lines of the vehicle's electrical system into the heating conductors on the windshield or rear window.

This problem will be explained with reference to the schematic depiction in FIG. 1. FIG. 1 depicts a glass pane, such as a windshield or rear window of a vehicle, in a window frame 2. The heating conductors form upon the window 1 a layer 3 made up of a single continuous and substantially transparent conductor, or made up of a plurality of discrete conductors. The conductor 3 carries current which results in the establishment of a magnetic field having field lines H. At a certain distance away from the conductive layer 3 the shape of the field is substantially as indicated in FIG. 1, and this field includes as constituent components the radio interference fields referred to above. If for example the receiving antenna is constituted by a conductor 4, the magnetic interference fields surrounding the conductor 4 induce interference voltages in the antenna conductor. Also emanating from the heating conductor layer 3 are electrical field lines E which have approximately the shape shown in FIG. 1 and likewise include interference fields as constituent components. Where the field lines of these interfering electrical fields intersect the antenna conductor 4, the displacement currents associated with these electrical fields will induce interference currents in the receiving antenna.

Accordingly, the interference fields from the heating conductors will interfere with the reception of high-frequency signals by the vehicle antenna, if the antenna is located in the vicinity of the heating conductors. This is the case to a particularly significant extent, for example, when the rear window of the vehicle is provided with both a large heating conductor system and also with receiving antenna conductors.

It is known to counteract this difficulty by providing filters in the supply lines for the heating conductor, for example choke coils for reducing interference currents in the heating conductors. However, this known expedient is effective only at relatively high frequencies and only over very limited bandwidths.

SUMMARY OF THE INVENTION

It is a general object of the invention to reduce the effect of the interference fields upon the receiving antenna over very large frequency ranges and even at relatively low frequencies, e.g., those associated with radio reception.

This object can be met according to one advantageous concept of the invention, by providing auxiliary conductors on or in the immediate vicinity of the window glass. These auxiliary conductors, with the possible exception of their end portions, are insulated from the heating conductors, and each at at least one of its ends is electrically connected to the metallic body of the vehicle for high-frequency conduction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 depicts the provision of the two conductor layers in an overlapped arrangement;

FIG. 7 depicts the connection of the auxiliary conductors to a conductive strip to which are also attached the heating conductors at one of the ends of the latter;

DESCRIPTION OF THE PREFERRED EMBODIMENTS

Figure 2:
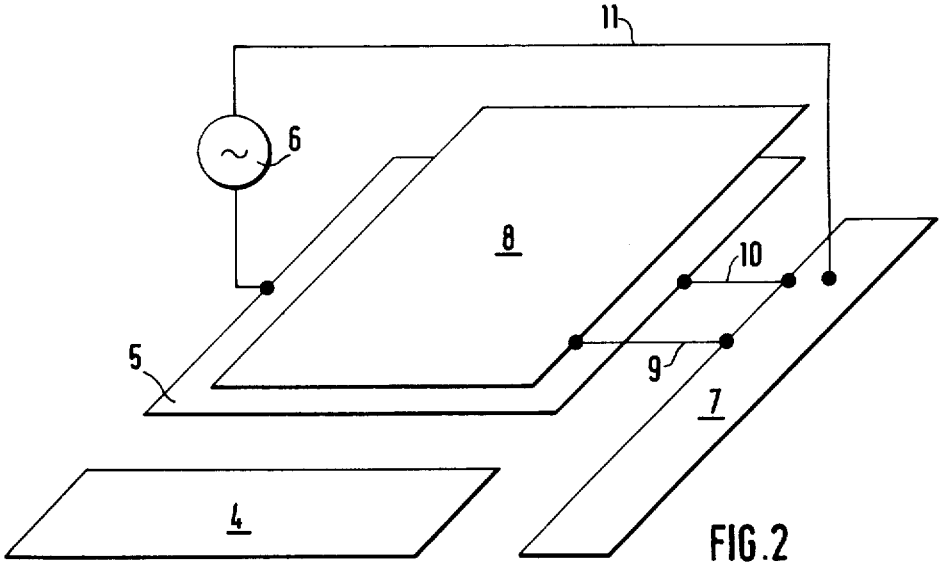
FIG. 2 schematically depicts one invention solution to the interference problem.

FIG. 2 depicts the arrangement of both a heating conductor system and an antenna conductor system on the windshield or rear window of an automotive vehicle, for the usual case where the heating conductors taken together substantially cover a surface 5. The heating conductors may constitute ports 5*b* a continuous substantially transparent conductive layer 5, or may be provided in the form of discrete interconnected conductor elements 6 represent the source of the heating current as well as of the superimposed interference currents. The first terminal of the source 6 is connected to the vehicle body 7; the second terminal is connected to one of the terminals of the heating conductor arrangement. The second terminal of the source 6 and the second terminal of the heating conductor arrangement 5 are connected to the vehicle body 7 via respective conductors 10 and 11. 4 denotes the receiving antenna subject to radio interference. Located in the vicinity of the heating conductor arrangement 5 is the auxiliary conductor arrangement 8 of the invention.

In the illustrated example, the auxiliary conductor arrangement 8 is likewise provided with laminar form, and it likewise consists of a single substantially transparent layer of electrically conductive material or else consists of an interconnected system of discrete wires. The auxiliary conductor layer 8 is insulated from the heating conductor layer 5 and connected to the vehicle body 7 via a conductor 9. If the conductor 10 has a very small resistance, one end of the heating conductor can be directly connected to one end terminal of the auxiliary conductor arrangement 8 or to corresponding ends of the discrete conductive elements thereof, with the conductors 9 and 10 then being provided in the form of a common conductor.

The conductor 9 need not afford a D.C. connection between the auxiliary conductor arrangement 8 and the vehicle body 7, because only high-frequency currents are to be carried. Accordingly, the conductor 9 need only afford a high-frequency connection exhibiting a sufficiently low impedance for all contemplated operating frequencies. Advantageously, the conductor 9 is provided with a series capacitor serving, in the case of undesired contact between the conductor layers 5 and 8, to protect the source 6 against a D.C. short-circuit.

FIGS. 3–17 will be referred to, to explain different possible designs for the auxiliary conductor arrangement 8, and different ways of insulating the auxiliary conductor arrangement 8 from the heating conductor arrangement.

Figure 3A:
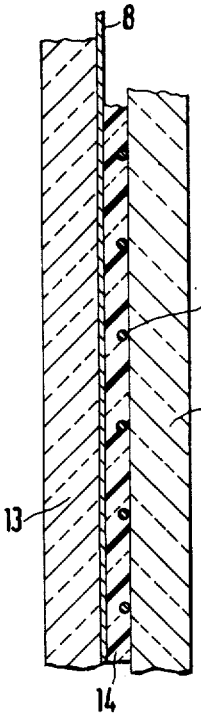
FIGS. 3*a* and 3*b* depicts the provision of the laminar conductors intermediate the components of a compound glass pane.
Figure 3B:
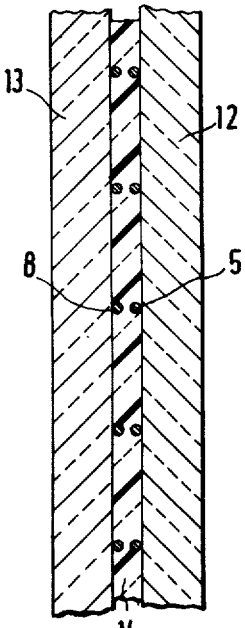

In FIGS. 3*a* and 3*b*, the windshield or rear vehicle window is made of compound glass consisting of two glass panes 12 and 13 separated from each other by an insulating layer 14. The conductive layers 5 and 8 are embedded in this insulating layer, electrically insulated from each other, in such a manner as to be provided on different respective ones of the glass panes 12 and 13. In the embodiment of FIG. 3*a*, the conductive layer 5 is made up of parallel discrete wires each of which appears in the illustrated sectional view as a small circle. The conductive layer 8 is a continuous layer of conductive material. In the embodiment of FIG. 3*b*, the conductive layers 5 and 8 are both made up of discrete wires. An advantage of providing the conductive layers in the interior of the compound glass pane 12, 13, 14 is that these layers are thereby protected from mechanical damage. Each of the two conductive layers can be provided on the surface of the respective glass layer before the glass layers are joined to form the compound glass pane.

Figure 4:
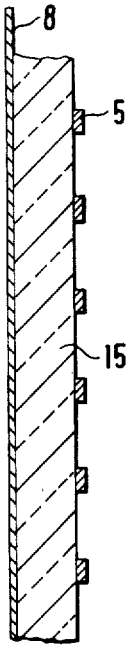
FIG. 4 depicts the provision of the laminar conductors on opposite surfaces of a glass pane.

In the example of FIG. 4, each of the two conductive layers 5, 8 is provided on a respective one of the two opposite surfaces of a single glass pane 15. The advantage of this possibility, as against that of FIG. 3, is the considerably lower cost of production.

In the example of FIG. 5, each of the two conductive layers 5, 8 is made up of parallel discrete conductive elements having the form of wires or strips all located on one and the same side of the glass pane 15. The constituent elements of the layers 5, 8 are so arranged that each is located intermediate two of the conductive elements of the other conductive layer. If both these conductive layers are thusly provided on the interior surface of the windshield or rear window, they will be well protected against the deleterious influence of weather conditions.

Figure 5A:
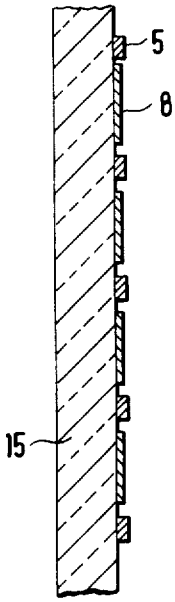
FIGS. 5*a*, 5*b* and 5*c* depict the provision of laminar conductors made up of discrete conductive components all provided on just one side of a glass pane.

FIG. 5*a* depicts an embodiment in which the conductive elements of the conductive layers 5, 8 are conductive strips, with the space intermediate neighboring strips being very small. In order to assure that the two conductive layers will not detract from visibility through the windshield or rear window, at least one of the conductive layers 5, 8 should be made up of conductive elements which are substantially transparent. If the auxiliary conductor arrangement 8 is to reduce only the effects of electrical interference fields, so that its constituent conductive elements need carry only very small currents, then those elements can be made of material so thin as to be virtually transparent. If nontransparent conductive elements are to be used, then larger intermediate spaces should be left between adjoining conductive elements.

Figure 5C:
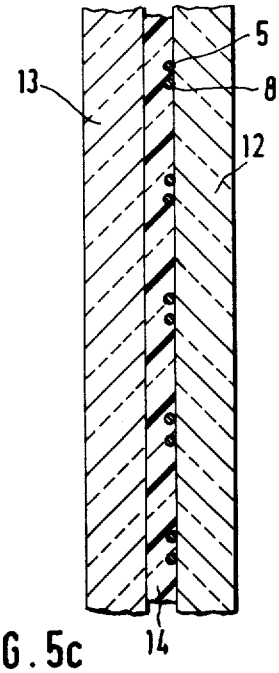
Figure 5B:
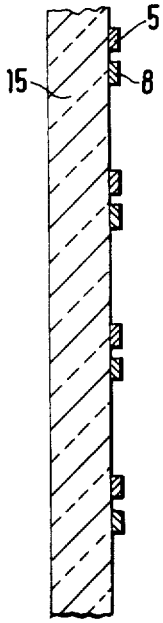
Figure 8:
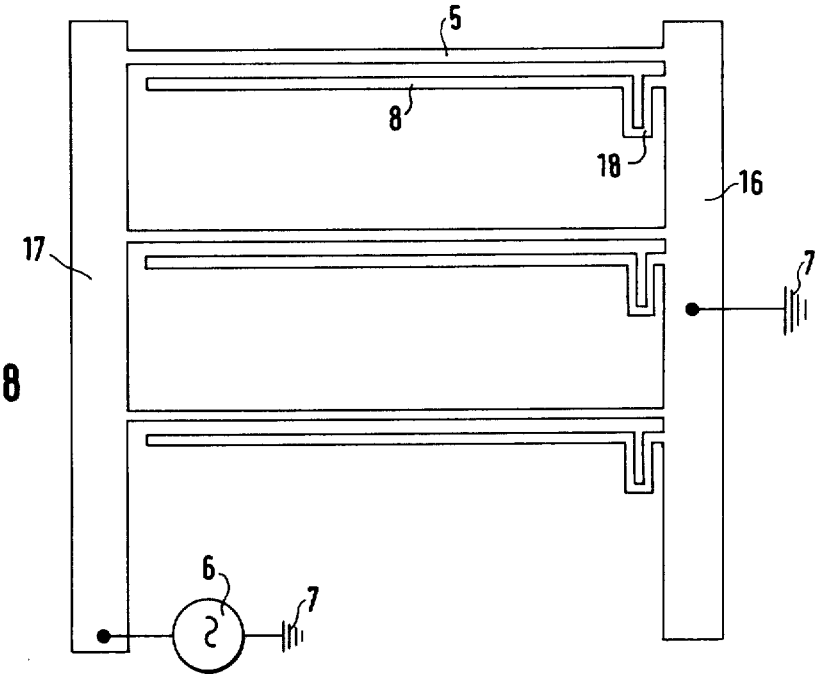
FIG. 8 depicts auxiliary conductors provided with protective resistors.

In general satisfactory reduction of the effects of electrical interference fields presupposes very small intermediate spaces between the conductive elements. With this in mind, in the embodiment of FIG. 5*b*, each conductive element of the auxiliary conductor arrangement 8 is arranged very close to one of the two adjoining conductive elements of the heating conductor arrangement 5, but quite far from the other, to leave a considerable space for the sake of viewability through the windshield. As shown in FIG. 5*c*, the expedient of FIG. 5*b* can also be used when the conductive elements are all arranged within the interior of a compound glass windshield or rear window 12, 13, 14.

FIG. 6 depicts an embodiment in which the conductive layer 8 has a centerpoint which is offset relative to the centerpoint of the conductive layer 5 in the direction toward the receiving antenna 4. Such an arrangement improves the interference suppression effect. The saving of material resulting from the provision of the conductive layer 8 over only that part of the conductive layer 5 adjoining the antenna 4 is not accomplished too much at the expense of the interference suppression effect, since the undesired coupling between the interference producing layer 5 and the antenna 4 is most considerable where the layer 5 adjoins the antenna 4. For this reason, it is advantageous that the conductive layer 8 projects past the conductive layer 5 toward the antenna 4, in order to counteract interference fields emanating from the conductive layer 5. The section of the conductive layer 5 remote from the antenna 4 will in many situations be coupled to the antenna to so small a degree that the provision of auxiliary conductors in this region can be acceptably dispensed with.

Figure 1:
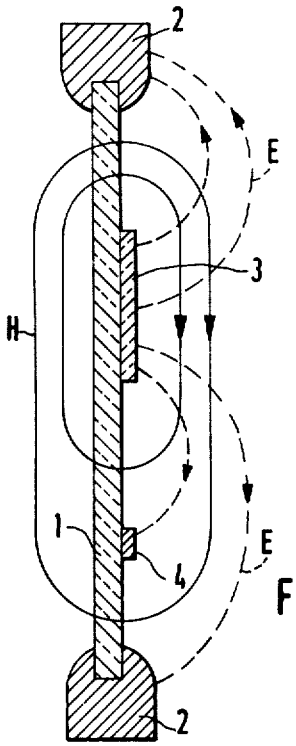
FIG. 1 depicts a heating conductor arrangement and an antenna conductor arrangement both provided in the windshield or rear window of an automotive vehicle, showing how the interference fields emanating from the heating conductors interfere with radio reception.

If the configuration of antenna 4 is such that the antenna receives electrical fields almost exclusively, e.g., if the antenna acts as a short dipole or monopole, then it is sufficient to protect the antenna only from electrical interference fields, with the conductive layer 8 being connected to the vehicle body 7 for high-frequency conduction only, as was the case in the embodiment of FIG. 2. The antenna will be subjected to interference only from those interference fields E whose field lines (as shown in FIG. 1) emanate from the conductor 5 and actually intersect the antenna conductor 4. On the other hand, if the auxiliary conductor arrangement 8 is present, and if in whole or in part it is located substantially closer to the conductor arrangement 5 than is the antenna 4, then most of the interference field lines E will intersect the conductor arrangement 8, with the interference field in the immediate vicinity of the antenna 4 accordingly being greatly attenuated.

FIG. 7 depicts an embodiment like that of FIG. 5, in which the heating conductors 5 are parallel wires extending from one to the other of two conductive strips 16, 17, with the strip 16 being energized by the source 6, and the strip 17 being electrically connected to the vehicle body 7 by low-resistance means. In the example of FIG. 7, the auxiliary conductive layer 8 is made up of discrete wires, each of which is at one end electrically connected to the strip 17 and extends into the intermediate space between two adjoining ones of the heating conductors. Here, as in FIG. 6, one or more of the individual wires of the conductive layer 8 can be located in the region between the receiving antenna 4 and the edge of the conductive heating layer 5.

In arrangements like that of FIG. 7, because of the small spacing between adjoining conductors, there is the danger of a direct electrical connection between conductors of layer 5 and conductors of layer 8, for example if individual conductors shift or become deformed. To prevent the creation of a short-circuit across the source 6, the embodiment of FIG. 8 includes resistors 18 incorporated at the ends of the conductors of layer 8 connected to the conductive strip 16. The resistance values of the resistors 18 are so chosen that, in the event of physical contact between the conductors of layer 5 and conductors of layer 8, the amount of current drawn from source 6 is kept within acceptable limits.

Figure 9:
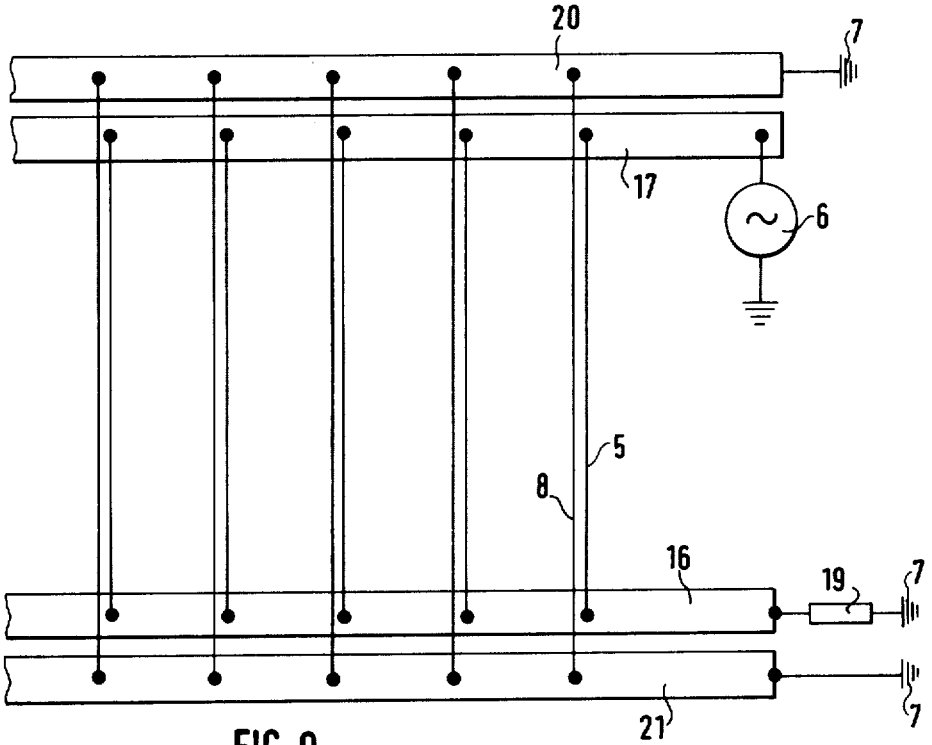
FIG. 9 depicts the connection of the conductors to four conductive strips.

When the heating conductor layer 8 via its strip 16 is electrically connected to the vehicle body 7 by means which are not of sufficiently low impedance, so that the connection 10 exhibits a non-negligible high-frequency impedance 19, high-frequency interference voltages will additionally exist between the strip 16 and the vehicle body 7, resulting in the generation of electrical interference fields. In that event, the ends of the conductors of layer 8 connected to strip 16 in FIG. 8 should not be connected to strip 16. Instead, as depicted in FIg. 9, use is made of a separate conductive strip 20 for connecting the auxiliary conductors of layer 8 to the vehicle body for high-frequency electrical conduction.

If not only the heating conductors, but also their strips 16, 17, produce electrical interference fields, and if the auxiliary conductors 8 are individual wires, then some of these auxiliary conductors must be laid out to extend along these strips closely spaced thereto, in order to intercept the interference fields emanating from the strips. As shown in FIG. 9, auxiliary strips 20, 21 can be provided in the vicinity of the strips 16, 17, both to intercept the electrical interference fields emanating from the strips and also to establish the terminal connections for the individual wires of auxiliary conductor layer 8.

Figure 10:
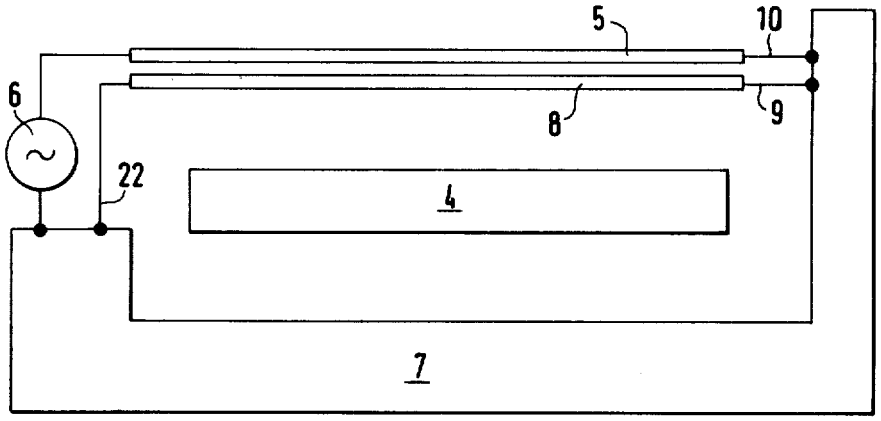
FIG. 10 depicts the shielding of the antenna against magnetic fields.

If the reception effected by antenna 4 is disturbed by magnetic interference fields emanating from the heating conductors, use should be made of arrangements of auxiliary conductors 8 which reduce the effect of the magnetic interference fields, as well as possibly also reducing the effect of the electrical interference fields. Such an arrangement is shown in FIG. 10. The magnetic interference fields result from interference currents flowing through the heating conductors 5. The effect of magnetic interference fields is only slightly counteracted when only a single connection 9 to the vehicle body 7 is used as in FIG. 2. The reason for this is as follows: A conductor layer 8 will satisfactorily reduce the effect of magnetic interference fields only if the conductors of layer 8 carry currents which are approximately as large as the interference currents carried in the conductors of layer 5, with these currents flowing in layer 8 at locations corresponding to those where interference currents flow in layer 5 and furthermore in the opposite direction. When two opposed and equal currents flow in closely neighboring conductors, the resultant magnetic field will be concentrated in the space intermediate the conductors, with the space surrounding the two conductors containing only a weak magnetic field. The production of such interference-reducing currents in the conductors 5 is made possible by the so-called neighboring effect, described for example in H. Meinke, "Einfuehrung in die Elektrotechnik hoeherer Frequenzen," volume 1, second edition, Berlin, 1965, pages 21 and 22 and section 17. The establishment of sufficiently high currents in the conductors 8 presupposes very small spacing between the conductors 8 and the corresponding ones of conductors 5; in the case of discrete wires, this would mean very small spacing between corresponding wires. The desired currents can be produced only if current paths of sufficiently low impedance are available. The one-sided connection of the conductors 8 by means of the connection 9 may not always be sufficient for this purpose. Accordingly, in that event, and as shown in FIG. 10, the second ends of the conductors of conductor group 8 (e.g., the strip 21 in FIG. 9) will be connected to the vehicle body 7 by means of a connection 22. For the sake of completeness, it is noted that when the interference fields to be counteracted are purely electrical, the connection 22 is not actually necessary; however, it may nevertheless be employed and may in some circumstances improve the interference suppression effect by improving the conductive connection between the conductor 8 and the vehicle body 7.

FIG. 10 also makes it possible to understand how the current-carrying auxiliary conductors 8 reduce the magnetic interference fields acting upon the antenna 4. If the conductors 8 were not present, or if no current flowed through them, the interference currents leaving the source 6 would return thereto via the conductors 5 and the vehicle body 7. In that event, the entire space intermediate the conductor 8 and the vehicle body, which space contains the antenna 4, would be filled by magnetic interference fields. With the conductor 8 present in the vicinity of the conductor 5, the interference currents leaving the conductor 5 return thereto via the connection 9, the conductor 8 and the connection 22, the antenna 4 being located far outside the boundaries of this current path.

In FIG. 10, for the sake of simplicity, only a single heating conductor 5 is depicted. Self-evidently, a plurality of such heating conductors can be present, as in FIG. 7. The magnetic fields produced by the current flowing through the conductor 8 will in that case, by virtue of opposite field orientation, partially offset the effect upon antenna 4 of the fields produced by the currents flowing through the conductor 5.

A sufficiently complete compensation for the effect upon the antenna of the magnetic interference fields is achieved only if currents flowing through the conductor 8 are almost the same magnitude as the currents flowing through the conductor 5. In the arrangement shown in FIG. 10, this condition will often not be met, because the current in current 5 splits at 10 into two currents, one flowing through the vehicle body 7 to the battery 6, with only the remainder flowing through the conductor 8.

Figure 11:
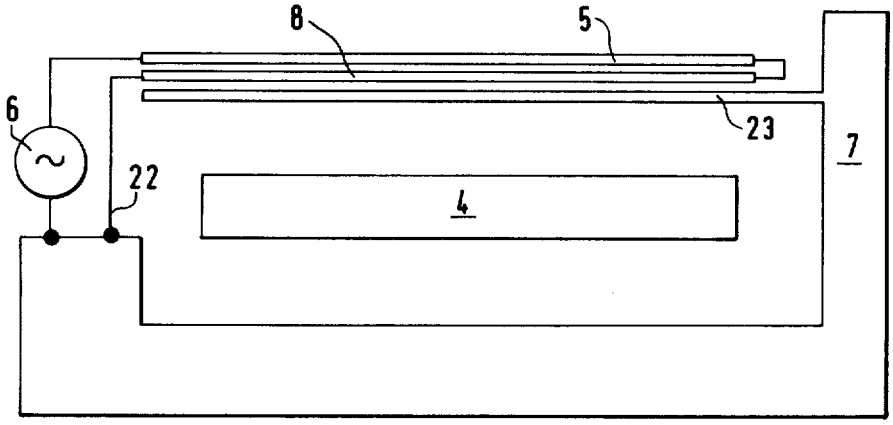
FIGS. 11 and 12 depict two further embodiments of the invention with a different arrangement of conductors.

The purpose of the embodiment shown in FIG. 11 is to achieve an almost complete compensation for the effect of magnetic interference fields upon the antenna.

This is achieved in FIG. 11 by connecting one end of the heating conductor 5 to one terminal of battery 6, connecting one end of an auxiliary conductor 8 to the other terminal of the heating conductor 5, and connecting the other terminal of the auxiliary conductor 8 to the other terminal of battery 6 via a connection 22. The auxiliary conductor 8 runs along the heating conductor 5 closely spaced thereto. Moreover, the auxiliary conductor 8 is not electrically connected to the vehicle body 7. As a result, the heating conductor 5 and the auxiliary conductor 8 carry substantially the same current and together form a bifilar conductor group. The opposing currents in conductors 5 and 8 will be approximately of equal magnitude, resulting in a substantially complete compensation of the effect of the magnetic interference fields produced by the flow of heating current through heating conductor 5.

However, this bifilar grouping does not in itself assure that there will be no electrical interference fields between the bifilar conductor group 5, 8 and the antenna 4. Accordingly, the invention contemplates providing one or more additional conductors 23 each electrically connected at only one end to the vehicle body 7. At least one of these additional conductors 23 is located closely spaced and parallel to the bifilar conductor group 5, 8 carrying the heating current. The additional conductors 23 serve to reduce the effect upon the antenna of electrical interference fields.

Since both conductors of the bifilar conductor group carry the heating current, it is another advantageous concept of the invention to utilize the auxiliary conductor 8 as another heating conductor, by using for conductor 8 a conductor of suitable resistance value. Preferably, the auxiliary conductor 8 will be made of the same conductive material as the heating conductor 5.

Usually, a plurality of such bifilar conductor groups would be provided on the windshield or rear window, connected together in parallel. In that event, to simplify energization of these conductor groups by the battery, it is advantageous to utilize connecting conductors 16, 17, preferably in the form of conductive strips such as shown in FIG. 7. For the case of multiple bifilar conductor groups, both these conductive connecting strips will be arranged along the same edge of the windshield or rear window, as illustrated in FIG. 12.

Even when the arrangements described above are employed, residual magnetic interference effects upon the antenna have been observed, especially at low frequencies. The causes of these effects are as follows:

In motor vehicles, one battery terminal and also one terminal of the heating wire arrangement are ordinarily connected directly with the vehicle body. Additionally, however, other electrical devices have one of their two terminals connected to the vehicle body. As a result, a considerable number of undefinable currents flow through the vehicle body producing interference fields affecting the antenna 4. Also, the points at which the additional conductors 23 are connected may be at indefinite potentials.

Figure 12:
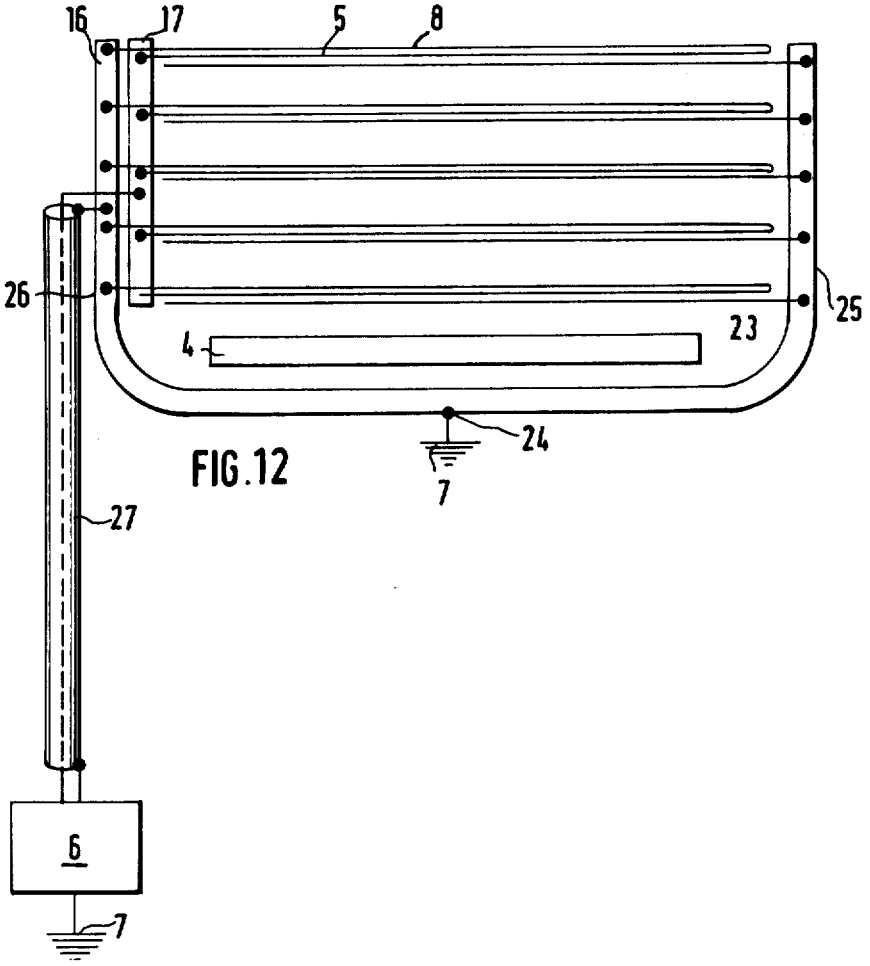

In order to produce definite fields in the vicinity of the antenna, the embodiment of FIG. 12 includes a current-carrying strip 16 which extends around the major portion of the edge of the windshield or rear window, being directly connected to the vehicle body 7 at only one point in the vicinity of the antenna 4. The additional conductors 23 are connected to the conductive strip 16 at locations 25 on the windshield opposite to the locations 26 at which the heating conductors are connected at their left ends to the strip 16. Accordingly, heating currents will flow only in the part of the conductive strip 16 intermediate the points 24 and 26, and not between the points 24 and 25. The additional conductors 23 are thus connected to the section of strip 16 which does not carry heating current, and are therefore electrically connected to the vehicle body 7 free of interference currents.

Additional indefinite interference effects can be eliminated by taking care that the vehicle body 7 does not carry heating current. This can be done by energizing the two current-carrying strips via a lead 27 the conductors of which are at no point directly connected to the vehicle body. Certain other interference effects can be avoided by using the lead 27 a shielded lead, such as a coaxial cable, so as to keep high-frequency interference fields entirely or at least partially away from the lead 27.

It will be understood that each of the elements described above, or two or more together, may also find a useful application in other types of circuits and constructions differing from the types described above.

While the invention has been illustrated and described as embodied in expedients for suppressing the effect upon automotive vehicle antennas of the fields produced by the flow of heating currents in windshield heaters and the like, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an automotive vehicle having a window and having a vehicle body, in combination, a window heater comprising an arrangement of heating conductors provided on the window; a radio receiving antenna located in the vicinity of the heating conductors; and an interference-suppressing arrangement for decreasing the effect upon the antenna of interference fields emanating from the heating conductors, the interference-suppressing arrangement comprising an arrangement of auxiliary conductors located in the vicinity of the heating conductors, the auxiliary conductors along their lengths being insulated from the heating conductors, each auxiliary conductor at at least one of the ends thereof being conductively connected to the vehicle body for high-frequency conduction.

2. The combination defined in claim 1, further including a series capacitor, the ends of the auxiliary conductors connected to the vehicle body being connected thereto through the series capacitor.

3. The combination defined in claim 1, the heating conductors being arranged in a first layer, the auxiliary conductors being arranged in a second layer, the first and second layers being approximately parallel to each other and closely spaced.

4. The combination defined in claim 1, the conductors of one of said arrangements being parts of a continuous layer of conductive material, the conductors of the other of said arrangements being provided in the form of discrete interconnected wires.

5. The combination defined in claim 1, the heating conductors being parts of a continuous layer of conductive material, the auxiliary conductors being parts of a continuous layer of conductive material.

6. The combination defined in claim 1, the heating conductors being provided in the form of discrete interconnected wires, the auxiliary conductors being provided in the form of discrete interconnected wires.

7. The combination defined in claim 1, each heating conductor at one of its ends being conductively connected by low-impedance means to the vehicle body, the auxiliary conductors each being conductively connected at one of their ends of those ends of the heating conductors which are conductively connected to the vehicle body.

8. The combination defined in claim 7, further including current-limiting resistor means, the ends of the auxiliary conductors connected to the ends of the heating conductors being connected thereto through the intermediary of the current-limiting resistor means, the current-limiting resistor means serving to protect against excessive current in the event of conductive contact between an auxiliary conductor and a heating conductor.

9. The combination defined in claim 3, the window being made of compound glass including outer layers and an intermediate layer of electrically insulating material, the auxiliary conductors being provided intermediate the outer layers of the compound glass.

10. The combination defined in claim 3, the heating conductors being provided on one of the two opposite surfaces of the window, the auxiliary conductors being provided on the other of the two opposite surfaces of the window.

11. The combination defined in claim 3, the heating conductors being arranged parallel to one another defining intermediate spaces therebetween, the auxiliary conductors being at least in part located in the respective ones of the intermediate spaces.

12. The combination defined in claim 11, each heating conductor and the respective neighboring one of the auxiliary conductors together forming a conductor group, the two conductors of each conductor group extending parallel and very closely spaced to each other, the spacing between adjoining conductor groups being substantially greater than the spacing of the two conductors within a conductor group.

13. The combination defined in claim 3, said first layer formed by the heating conductors having a respective first center point, said second layer formed by the auxiliary conductors having a respective second center point, said second center point being offset relative to said first center point in the direction toward the radio receiving antenna.

14. The combination defined in claim 11, the window heater further comprising a current source, a first electrically conductive contact strip conductively connected to the current source, and a second electrically conductive contact strip conductively connected to the vehicle body, the heating conductors being provided in the form of discrete parallel wires each conductively connected at its first end to the first contact strip and at its second end to the second contact strip, each auxiliary conductor being conductively connected at one of its two ends to the second contact strip.

15. The combination defined in claim 11, the interference-suppressing arrangement further including a third electrically conductive contact strip arranged parallel to and in the immediate vicinity of the first contact strip, and a fourth electrically conductive contact strip arranged parallel to and in the immediate vicinity of the second contact strip, the third and fourth contact strips being conductively connected to the vehicle body, each auxiliary conductor being conductively connected at one of its ends to the third contact strip and at the other of its ends to the fourth contact strip.

16. The combination defined in claim 1, each auxiliary conductor being conductively connected to the vehicle body at both its ends.

17. The combination defined in claim 1, the window heater further including a current source, each auxiliary conductor extending closely spaced to a respective one of the heating conductors to form with such heating conductor a bifilar conductor group, each heating conductor being connected at its one end to one terminal of the current source and at its other end being connected not to the vehicle body but instead to one end of the auxiliary conductor of its bifilar conductor group so that the same current flows through both the heating conductor and the auxiliary conductor of the conductor group, the interference-suppressing arrangement additionally including at least one further conductor extending closely spaced and parallel to a respective one of the bifilar conductor groups conductively connected at one of its two ends to the vehicle body.

18. The combination defined in claim 17, each auxiliary conductor having a resistance such that it effects heating of the window to an extent comparable to that of its associated heating conductor.

19. The combination defined in claim 18, the heating conductor and auxiliary conductor of each bifilar conductor group being made of the same conductive material.

20. The combination defined in claim 17, the window heater and interference-suppressing arrangement further including a current source, a first conductive contact strip, and a second conductive contact strip, the auxiliary conductors at the ends thereof not connected to the associated heating conductors being conductively connected to the first contact strip, the heating conductors at the ends thereof not connected to the associated auxiliary conductors being conductively connected to the second contact strip, one of the contact strips extending around a major portion of the edge region of the vehicle window and being conductively connected to the vehicle body at a single location in the vicinity of the antenna and being conductively connected to the current source at another location, each further conductor being conductively connected to said one of the contact strips at places on the contact strip which are not intermediate said locations.

21. The combination defined in claim 20, further including a two-conductor lead, said one of the contact strips being connected to the current source through the two-conductor lead, the two conductors of the lead being nowhere directly connected to the vehicle body.

22. The combination defined in claim 21, the two-conductor lead being a coaxial-type shielded lead.

* * * * *